US006763957B1

(12) United States Patent
Mullerleile

(10) Patent No.: US 6,763,957 B1
(45) Date of Patent: Jul. 20, 2004

(54) TRANSLUCENT SLATWALL PANELS AND DISPLAY SYSTEMS INCORPORATING THE SAME

(75) Inventor: Daniel Mullerleile, Grand Haven, MI (US)

(73) Assignee: KSDM, LLC, Ada, MI (US)

( * ) Notice: Subject to any disclaimer, the term of this patent is extended or adjusted under 35 U.S.C. 154(b) by 102 days.

(21) Appl. No.: 10/064,349

(22) Filed: Jul. 3, 2002

Related U.S. Application Data

(60) Provisional application No. 60/302,996, filed on Jul. 3, 2001.

(51) Int. Cl.[7] ..... A47F 5/08

(52) U.S. Cl. ..... 211/94.01; 211/94.02; 211/59.1; 248/224.51

(58) Field of Search ..... 211/94.01, 94.02, 211/57.1, 59.1, 189, 175, 87.01, 40; 52/36.4, 36.5, 27, 12, 23, 506.08; D25/123, 125; 248/224.41, 224.51, 224.61, 220.21, 222.11, 223.41

(56) References Cited

U.S. PATENT DOCUMENTS

| | | | | | |
|---|---|---|---|---|---|
| 1,781,991 | A | * | 11/1930 | Stover | 223/88 |
| 2,683,891 | A | * | 7/1954 | Rosenbaum | 16/87.4 R |
| 4,308,961 | A | * | 1/1982 | Kunce | 211/94.01 |
| 4,358,018 | A | * | 11/1982 | Wolfe | 211/40 |
| 4,531,331 | A | * | 7/1985 | Itagaki | 52/38 |
| 4,607,753 | A | * | 8/1986 | Radek | 211/94.01 |
| 4,694,965 | A | * | 9/1987 | Parnell | 211/87.01 |
| 4,747,025 | A | | 5/1988 | Barton | |
| 4,752,010 | A | * | 6/1988 | Holztrager | 211/90.02 |
| 4,805,784 | A | | 2/1989 | Solheim et al. | |
| 4,869,378 | A | * | 9/1989 | Miller | 211/94.01 |
| 4,942,498 | A | * | 7/1990 | Toussaint | 361/709 |
| 5,142,832 | A | * | 9/1992 | Branham et al. | 52/36.4 |
| 5,212,913 | A | * | 5/1993 | Whitehead | 52/57 |
| 5,228,579 | A | * | 7/1993 | Kaufman | 211/94.01 |
| 5,241,796 | A | * | 9/1993 | Hellwig et al. | 52/36.4 |
| 5,333,741 | A | * | 8/1994 | Yang | 211/40 |
| 5,356,104 | A | | 10/1994 | Rosenberg et al. | |
| 5,375,802 | A | * | 12/1994 | Branham, II | 248/221.11 |
| 5,412,912 | A | | 5/1995 | Alves | |
| 5,431,761 | A | | 7/1995 | Holztrager | |
| 5,511,675 | A | * | 4/1996 | Frederick | 211/193 |
| 5,655,674 | A | * | 8/1997 | Holztrager | 211/94.01 |
| 5,667,083 | A | * | 9/1997 | Schnoor et al. | 211/41.12 |
| 5,690,239 | A | * | 11/1997 | Ballard | 211/189 |
| 5,775,521 | A | * | 7/1998 | Tisbo | 211/94.01 |
| 5,791,093 | A | | 8/1998 | Diamond | |
| 5,819,490 | A | | 10/1998 | Current | |
| 5,899,344 | A | * | 5/1999 | Current et al. | 211/94.01 |
| 5,921,044 | A | * | 7/1999 | Holztrager | 52/483.1 |
| 5,938,158 | A | | 8/1999 | Tisbo | |
| 5,941,026 | A | | 8/1999 | Eisenreich et al. | |
| 5,944,203 | A | * | 8/1999 | Vlah et al. | 211/189 |
| 5,984,439 | A | | 11/1999 | Orr et al. | |
| 6,119,878 | A | * | 9/2000 | Zen | 211/94.01 |
| 6,134,846 | A | | 10/2000 | Lamb | |
| 6,158,597 | A | * | 12/2000 | McDermott | 211/45 |
| 6,164,467 | A | * | 12/2000 | DePottey et al. | 211/189 |
| 6,185,899 | B1 | * | 2/2001 | De Niet | 52/762 |
| 6,220,461 | B1 | | 4/2001 | Dickinson | |
| 6,299,004 | B1 | * | 10/2001 | Thalenfeld et al. | 211/90.01 |
| 6,325,223 | B1 | * | 12/2001 | Hannen | 211/87.01 |
| 6,349,507 | B1 | * | 2/2002 | Muellerleile | 52/36.5 |
| 6,397,534 | B1 | * | 6/2002 | Hager et al. | 52/239 |
| 6,439,399 | B1 | * | 8/2002 | Wegstein et al. | 211/55 |
| 6,491,172 | B2 | * | 12/2002 | Chance et al. | 211/87.01 |

FOREIGN PATENT DOCUMENTS

| | | | | |
|---|---|---|---|---|
| GB | WO 99/55205 | * | 11/1999 | 211/94.01 |

* cited by examiner

*Primary Examiner*—Jennifer E. Novosad
(74) *Attorney, Agent, or Firm*—McGarry Bair PC

(57) ABSTRACT

A slatwall assembly comprises at least one slatwall panel having a cross section comprising at least one arcuate retaining flange and at least one planar brace adapted to accept standard slatwall hooks and other accessories. The slatwall panel can be constructed of an extruded translucent polymeric material having selected light transmission and visibility qualities ranging from transparent to opaque, and clear to colored.

44 Claims, 10 Drawing Sheets

TRANSLUCENT SLATWALL PANELS AND DISPLAY SYSTEMS INCORPORATING THE SAME

CROSS REFERENCE TO RELATED APPLICATIONS

This application claims the benefit of U.S. provisional application Serial No. 60/302,996, filed Jul. 3, 2001.

BACKGROUND OF INVENTION

1. Field of the Invention

The invention relates to a slatwall construction for hanging supporting fixtures. In one of its aspects, the invention relates to a slatwall construction that has improved aesthetic appearance yet is functional for hanging supporting fixtures or display of articles. In another of its aspects, the invention relates to a slatwall construction that is at least partially transparent for providing light transmission and improved aesthetics. In another of its aspects, the invention relates to a slatwall construction having an improved fixture retainer.

2. Description of the Related Art

Slatwalls well-known in the industry are formed of sheet metal that is roll formed into a shape with retaining flanges for hanging fixtures on a wall. Slatwalls have also been formed of extrusions such as aluminum. Aluminum slatwalls are advantageous in that they provide a load-bearing capacity approaching that of steel at a fraction of the weight. As a result, aluminum extrusions can be used in both taller and narrower or shallower displays, and are particularly advantageous in freestanding displays. The use of taller displays, however, reduces the light that can spill through the display from one open area to the next. A taller display made of an opaque material such as aluminum also restricts the vision of those responsible for security, especially in a retail establishment. Oftentimes, these displays support articles of minimal weight such that the aluminum extrusions are overly strong relative to the load being supported.

Conventional slatwalls use panels with upwardly-opening channels that interlock to form a wall and provide a means of suspending a fixture, such as a hook. The hook generally has a downwardly-extending flange that is inserted into the channel and is thereby supported on the slatwall. The hook is not locked into the slatwall channel, and can easily be displaced by an upwardly-directed impact. If the hook supports commercial products as part of a commercial display, displacement of the hook can disrupt the display, with potential damage to the product. Other slatwall systems utilize threaded fasteners, such as screws, to join the panels together, necessitating extra components and complicating the construction of the slatwall system.

SUMMARY OF INVENTION

According to the invention, a panel for a slatwall assembly comprises a rectangular wall which forms a structural spine defined by an upper edge, a lower edge, side edges, a front face, and a rear face. The panel has at least one retaining flange extending outwardly from the front face of the wall, having an arcuate outer end defining a retaining channel adapted to receive a support fixture. The panel also has at least one brace extending outwardly from the front face of the wall a distance coextensive with the arcuate outer end of the retaining flange.

Further according to the invention, at least two of the panels are mounted in vertical juxtaposition in a frame formed of a pair of vertical side frame members, and each of the vertical side frame member defines an elongate cavity for receiving a side edges of the slatwall panels. The frame is further formed of at least two horizontal frame members, a first horizontal frame member defines an elongate cavity for receiving an upper edge of one slatwall panel and a second horizontal frame member defines an elongate cavity for receiving a lower edge of another slatwall panel. The at least two vertical side frame members and the at least two horizontal frame members are assembled into a rectilinear frame with the at least two slatwall panels supported therein in vertical juxtaposition.

Further according to the invention, a fixture is mounted to at least one of the panels and a display article is mounted to the fixture.

In one embodiment, the upper edge and the lower edge form connectors for joining like panels together in vertical juxtaposed relationship. One of the connectors comprises a flange forming a male connector, and one of the connectors comprises a pair of parallel, spaced-apart flanges forming a female connector. In yet another embodiment, the retaining flange is J-shaped, and the brace has a linear cross-section. In a further embodiment, the panel is formed of an extrusion, which can comprise a translucent plastic, a clear polyvinyl chloride, or can be color tinted.

In yet another embodiment, the panel further comprises at least one retaining flange extending outwardly from the rear face of the rectangular wall, having an arcuate outer end defining a retaining channel adapted to receive a support fixture. In yet another embodiment, the panel further comprises at least one brace extending from the rear face of the rectangular wall a distance coextensive with the arcuate outer end of the retaining flange extending from the rear face.

In another embodiment, the retaining flange extending from the rear face is J-shaped, and the brace extending from the rear face has a linear cross-section. Furthermore, this extrusion can be a translucent plastic, can comprise a clear polyvinyl chloride, and can be color tinted.

BRIEF DESCRIPTION OF DRAWINGS

In the drawings:

FIG. 11 A is a detailed view of a cross connector shown in FIG. 11 for connecting slatwall sections into the upright display of FIG. 10.

DETAILED DESCRIPTION

Figure 1:
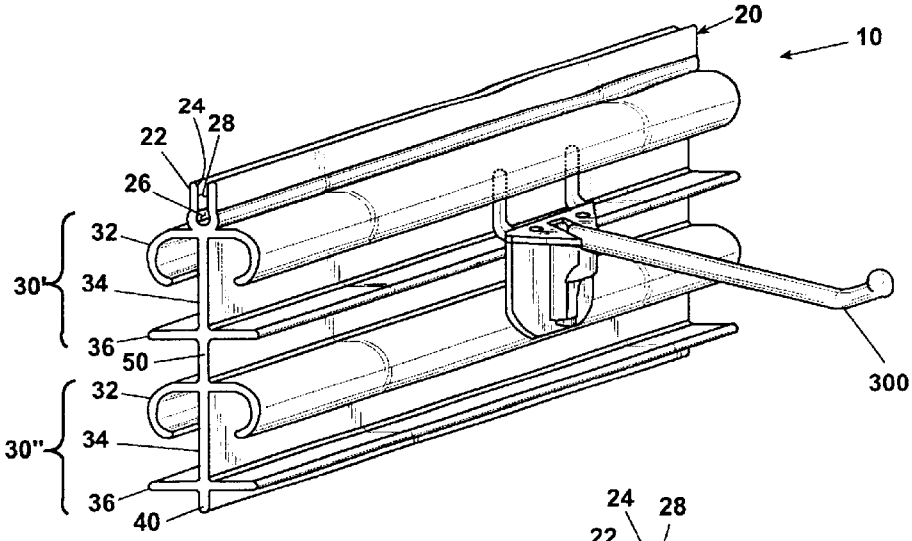
FIG. 1 is a perspective view of a slatwall panel section according to the invention.
Figure 2:
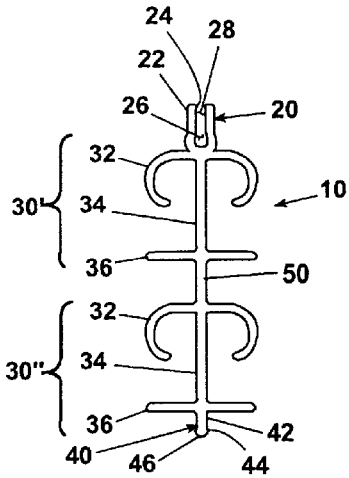
FIG. 2 is an end view of the slatwall section of FIG. 1.

Referring to FIGS. 1–2, a preferred embodiment of a slatwall panel 10 according to the invention comprises an elongate extrusion shown with a vertical orientation. The material used to form the slatwall panel 10 can be metal, such as aluminum, or plastic. In one embodiment, the panel is made from extruded aluminum. In another embodiment, the panel is made from an extruded plastic. In a preferred embodiment, the extruded plastic is translucent, preferably, tinted with a color. The extruded plastic can vary in clarity from transparent to nearly opaque, but retaining a translucent quality. The material can be tinted to match an architectural color scheme, or can be untinted. The material can also be texturized, thereby enhancing its aesthetic and translucent qualities. The preferred plastic material is clear PVC. A suitable clear PVC is made by Bayshore Rigids, L.L.C. of Tennent, N.J., under the trade designations 14311, 15311 and 13311. The slatwall panel 10 is adapted to removably support slatwall accessories, as exemplified by the slatwall hook 300 shown in FIG. 1.

The slatwall panel 10 includes an upper "female" connector 20 along an upper longitudinal edge comprising a pair of opposing vertical flanges 22 defining a channel 28 therebetween, each of the flanges 22 including a detent 24 projecting inwardly into the channel 28 to thereby narrow the channel 28 at the detent 24. The channel 28 further includes a widened base portion forming a cavity 26 being substantially circular in cross section and of a width for receiving a threaded fastener 76, such as a screw (FIG. 8), for securing an end cap 70 to the slatwall panel 10.

Figure 3:
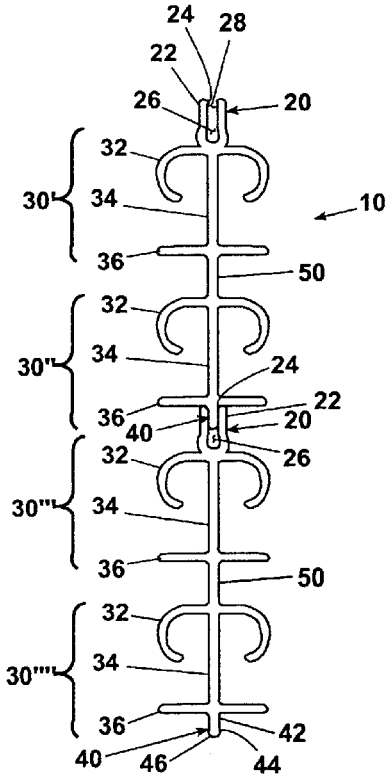
FIG. 3 is an end view of two joined slatwall sections according to FIG. 2.

The slatwall panel 10 further comprises a pair of slatwall rows 30', 30" positioned below the upper connector 20. The slatwall row 30' comprises a J-shaped retainer 32 projecting perpendicularly outwardly from a central axis of slatwall panel 10. In the embodiment of FIGS. 1–3, each slatwall row 30' comprises opposing J-shaped retainers 32 so that the cross section of the slatwall panel 10 is symmetrical about a central axis. Each slatwall row 30' further comprises a horizontal member 36 spaced from the J-shaped retainer by a vertical rib 34 on the central axis of the slatwall panel 10. Like the J-shaped retainer 32, the horizontal member 36 is symmetrical about the central axis of the slatwall panel 10. The slatwall panel 10 of FIGS. 1–3 further comprises a second slatwall row 30" connected to the first slatwall row 30' by a connecting rib 50. In the disclosed embodiment, the slatwall panel 10 includes two slatwall rows 30', 30" joined by one connecting rib 50, but a slatwall panel 10 can include any number of slatwall rows 30'–30"".

Slatwall panel 10 further comprises a lower "male" connector 40 along a lower longitudinal edge shown below the lowermost slatwall row 30". The lower connector 40 comprises a vertical flange 42 centered on the central axis of the slatwall panel 10, the lower connector 40 having a connector tip 44 and a pair of detents 46 projecting outwardly from the central axis of the slatwall panel 10 a predetermined distance away from the tip 44 of the lower connector 40.

Referring now to FIG. 3, a pair of slatwall panels 10 are joined so that their central axes align, with lower "male" connector 40 of an upper slatwall panel 10 occupying the channel 28 of the upper "female" connector 20 of a lower slatwall panel 10. Lower connector 40 of upper slatwall panel 10 can be inserted directly into channel 28 as upper and lower slatwall panels 10 are moved toward one another along their central axes due to resiliency of the vertical flanges 22 of upper connector 20. Removal of lower connector 40 from upper connector 20 is resisted by the interaction of inwardly projecting detents 24 of the upper connector 20 and the outwardly projecting detents 46 of lower connector 40. In the alternative, lower connector 40 can be inserted in upper connector 20 by a relative longitudinal displacement in the direction of the plane defined by the slatwall panels 10, effectively sliding lower connector 40 into channel 28 of upper connector 20.

Referring to FIG. 3, upper and lower connectors 20, 40 and connecting rib 50 are sized such that the interval between succeeding slatwall rows 30'–30"" remains uniform within each slatwall panel 10 and across the joint between adjacent slatwall panels 10. It is also anticipated that the intervals between slatwall rows 30'–30"" can vary within each slatwall panel 10 or across the joint between adjacent slatwall panels 10.

Figure 4:
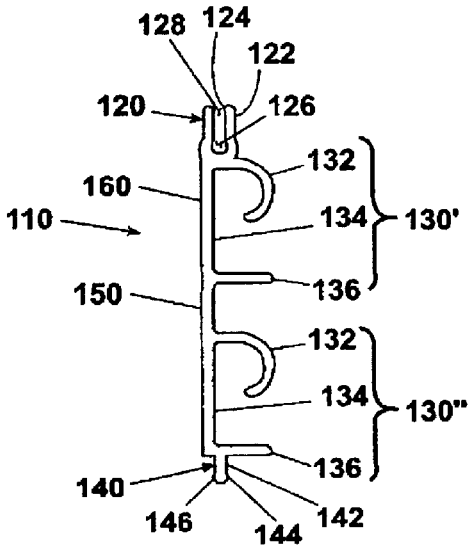
FIG. 4 is an end view of a further embodiment of a slatwall section according to the invention.
Figure 5:
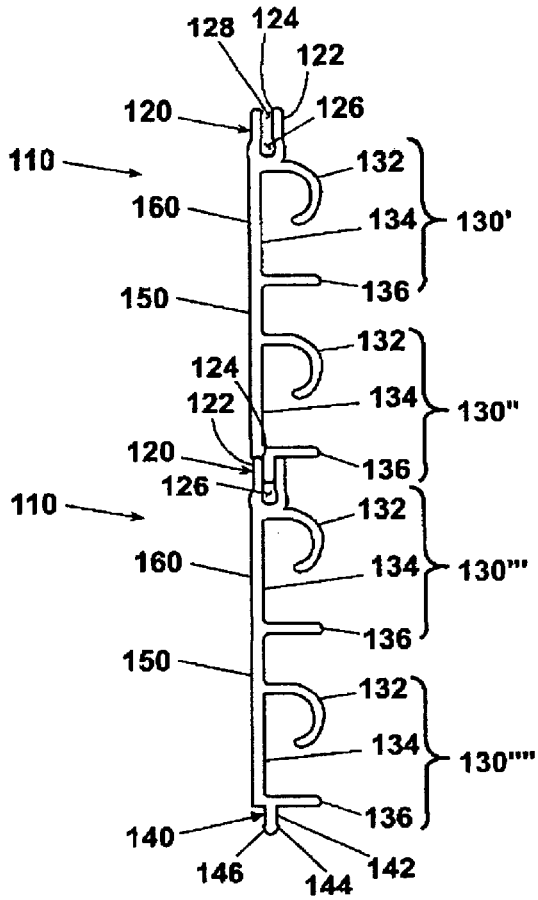
FIG. 5 is an end view of two joined slatwall sections according to FIG. 4.

FIGS. 4–5 disclose a further embodiment of a slatwall panel 110 similar in overall configuration and components to the slatwall panel 10 of FIGS. 1–3, having upper "female" connector 120 comprising two vertical flanges 122 defining a channel 128 therebetween, the channel 128 having a widened base portion forming a cavity 126. Each of the vertical flanges 122 includes an inwardly projecting detent 124. The slatwall panel 110 further comprises at least one slatwall row 130' comprising a J-shaped retainer 132 and a horizontal member 136 separated from the J-shaped retainer 132 by a vertical rib 134. Successive slatwall rows 130", 130'", 130"" are joined by a connecting rib 150. Unlike the slatwall panels 10 of FIGS. 1–3, however, slatwall panels 110 of FIGS. 4–5 are not symmetrical about a central axis but rather have a flat face 160. Upper and lower connectors 120, 140 are offset from the flat face 160. The lower connector 140 comprises a vertical flange 142 offset from the central axis of the slatwall panel 110, the lower connector 140 having a connector tip 144 and a pair of detents 146 projecting outwardly from the central axis of the vertical flange 142 a predetermined distance away from the tip 144 of the lower connector 140. Referring to FIG. 5, the offset upper and lower connectors 120, 140 join successive slatwall panels 110 such that the flat face 160 of each slatwall panel 110 is effectively continuous with the flat face 160 of adjoining panels 110.

Figure 6:
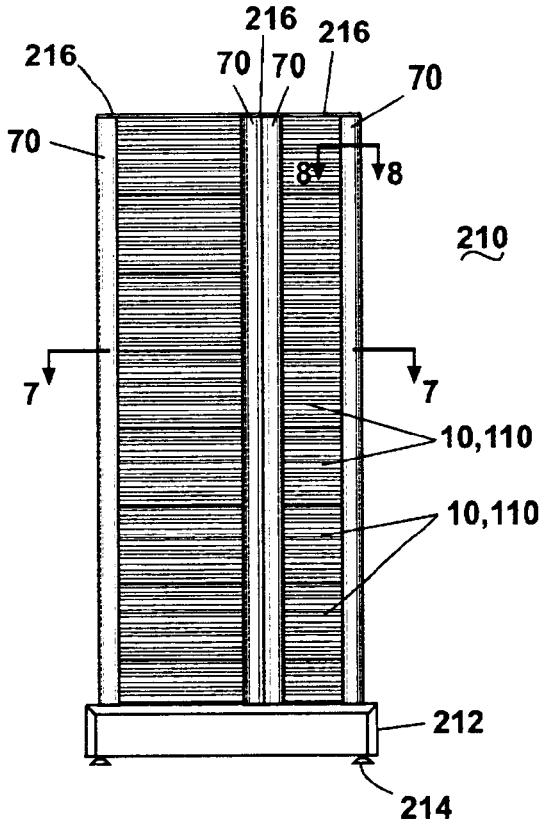
FIG. 6 is an elevation view of an upright display constructed of slatwall according to the invention.
Figure 7:
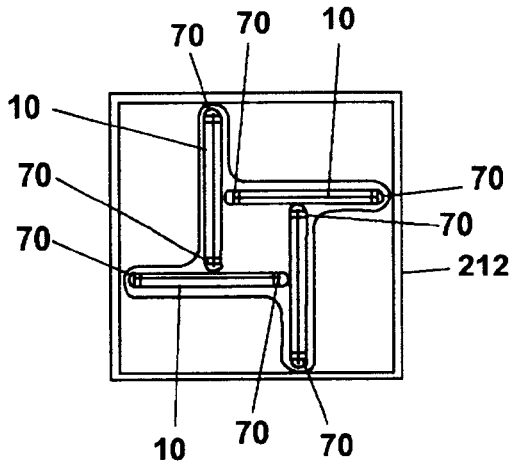
FIG. 7 is a cross-sectional view taken through line 7—7 of FIG. 6.
Figure 8:
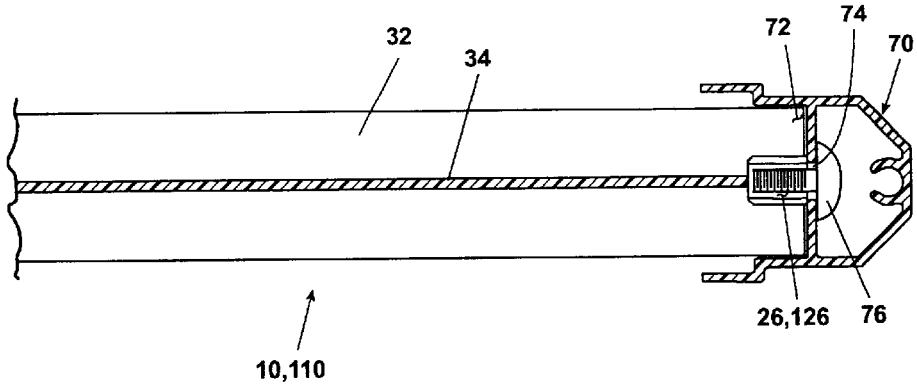
FIG. 8 is a cross-sectional view taken through line 8—8 of FIG. 6.
Figure 9:
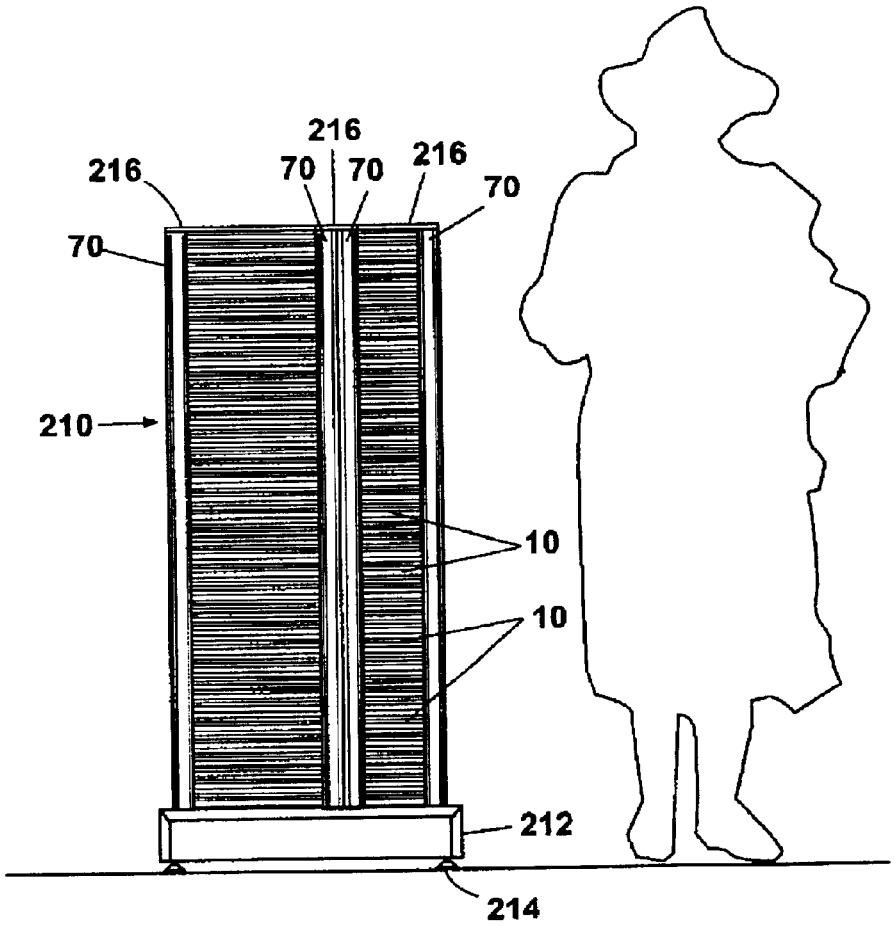
FIG. 9 is an elevation view of the upright display of FIG. 6 shown for scale next to a human silhouette.

Referring to FIGS. 6–8, an exemplary display 210 comprises a generally conventional base 212 supported by generally conventional adjustable feet 214 and a plurality of slatwall panels 10, 110 supported thereon, the slatwall panels 10,110 aligned along their central axes with upper connectors 20 and lower connectors 40 interlocked as heretofore described. An elongate end cap 70 having a generally U-shaped cross section defining a central elongate cavity 72 and including a channel 74 at the base of the cavity 72 is placed over an end of the slatwall panels 10, 110 so the ends of the slatwall panels 10, 110 are received in the cavity 72. A fastener 76, such as a screw, is fixedly received in the boss/cavity 26, 126 of each slatwall panel. 10, 110 so that the head of the fastener 76 is spaced from the end of the slatwall panel 10, 110 by a body of the fastener 76 such that the body of the fastener 76 can pass through the channel 74 and the head of the fastener 76 cannot. The display is thus assembled by longitudinally sliding the end cap 70 relative to the ends of the slatwall panels 10, 110 so that the body of the fastener 76 passes through the channel 74, the head of the fastener 76 preventing the end cap 70 from being removed from the end of slatwall panels 10, 110. The display 210 further includes a plurality of generally conventional top caps 216 which, in the preferred embodiment, are adapted to matingly communicate with the upper connectors 20 of the uppermost panels 10. Referring to FIG. 9, the display 210 is shown for scale next to a human silhouette.

Figure 10:
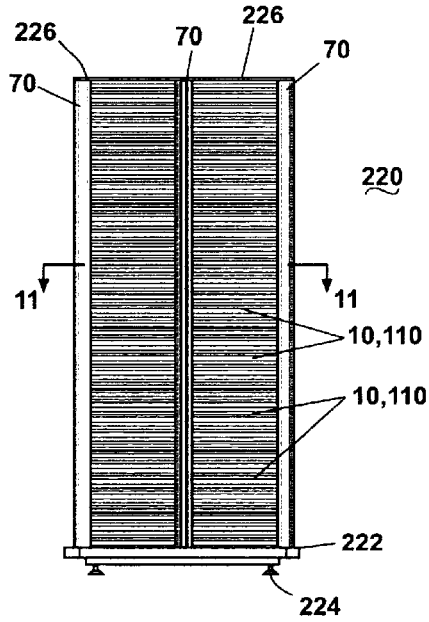
FIG. 10 is an elevation view of a further embodiment of an upright display according to the invention.
Figure 11:
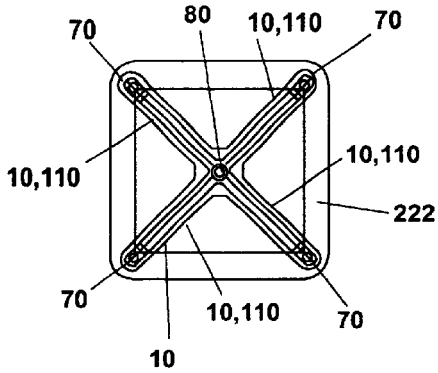
FIG. 11 is a cross-sectional view taken through line 11—11 of FIG. 10.
Figure 11A:
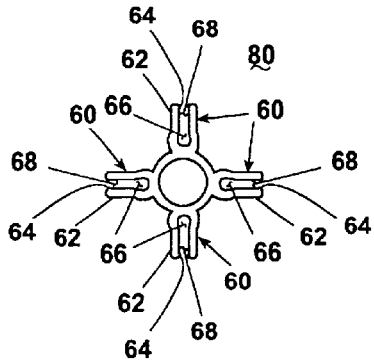

Referring now to FIGS. 10–11, a further embodiment of a display 220 according to the invention comprises a plurality of slatwall panels 10, 110 supported by a base 222 on adjustable feet 224, slatwall panels 10, 110 arranged in a cross configuration having a central cross connector 80, each of the arms across being finished on an outer end by an end cap 70, and comprising a plurality of top caps 226. As shown in FIG. 11A, the cross connector 80 comprises four orthogonally-connected grips 60 comprising a pair of opposing vertical flanges 62 defining a channel 68 therebetween, each of the flanges 62 including a detent 64 projecting inwardly into the channel 68 to thereby narrow the channel 68 at the detents 64. The channel 68 further terminates in a widened base portion 66 forming a cavity being substantially circular in cross section.

Figure 12:
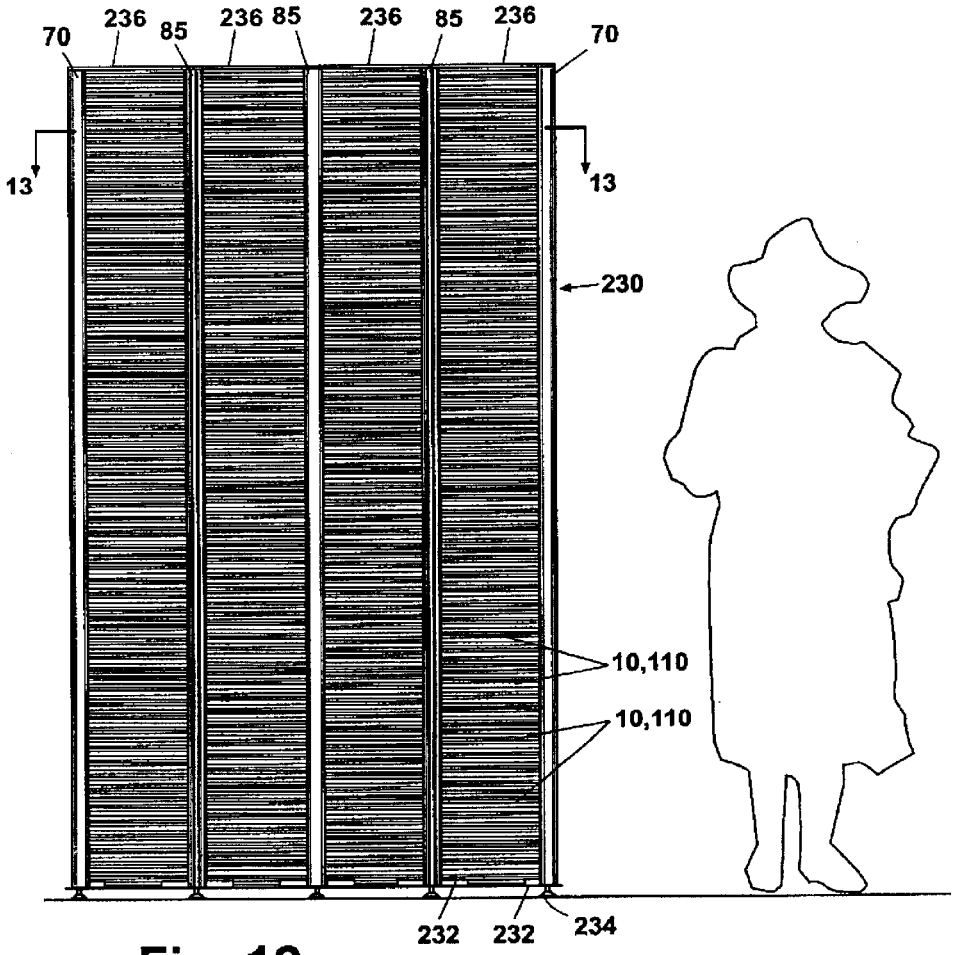
FIG. 12 is an elevation view of a further embodiment of an upright display according to the invention shown for scale next to a human silhouette.
Figure 13:
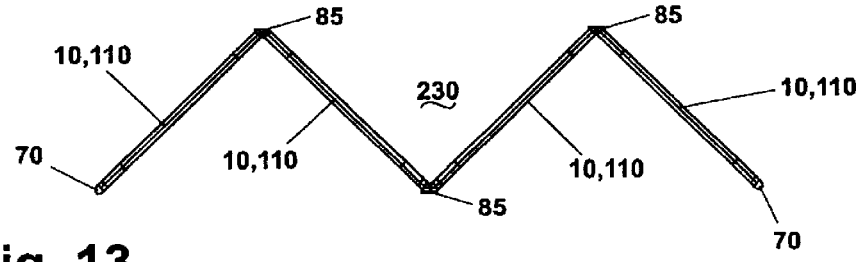
FIG. 13 is a cross-sectional view taken through line 13—13 of FIG. 12.

FIGS. 12–13 disclose a further embodiment of the display 230 according to the invention, shown for scale next to a human silhouette, that comprises a plurality of slatwall panels 10, 110 supported by a bottom channel section 232 on adjustable feet 234, and capped with a plurality of top caps 236. Slatwall panels 10, 110 of display 230 are terminated at each end of the display 230 by an end cap 70. The display 230, in the cross-sectional view of FIG. 13, describes an "M," each section of the display connected by an angled connector 85, such as a right angle connector or a connector having any other desired angle.

Figure 14:
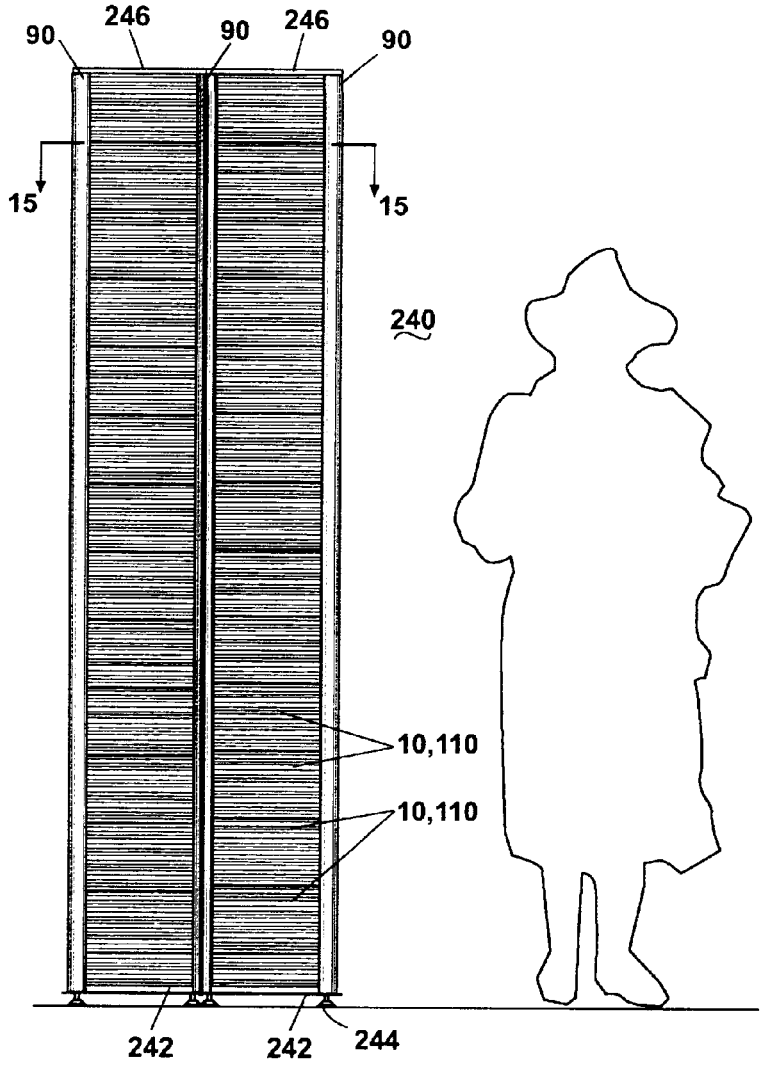
FIG. 14 is an elevation view of a further embodiment of an upright display according to the invention shown for scale next to a human silhouette.
Figure 15:
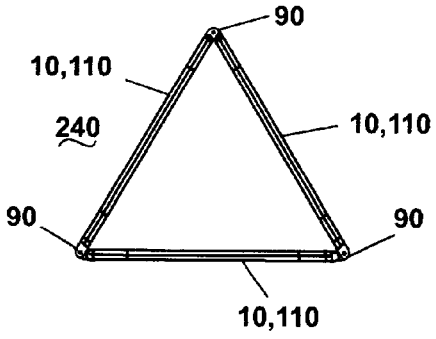
FIG. 15 is a cross-sectional view taken through line 15—15 of FIG. 14.

FIGS. 14–15 disclose a further embodiment of a display 240 according to the invention shown for scale next to a human silhouette. The display 240, as shown in the cross-sectional view of FIG. 15, is triangular and includes legs comprising a plurality of slatwall panels 10, 110, each of the legs joined by an acute angle connector 90. The acute angle connector 90 further serves the function of holding the slatwall panels 10, 110 in the same fashion as the end cap 70 in the previous embodiments. In the preferred embodiment, the connector 90 defines a 60° angle for a display forming an equilateral triangle. However, the connector 90 can be provided with selectively different angles, or with a pivoting apex to enable orienting the panels 10, 110 at angles of varying degrees for displays of differing configurations. The display 240 is supported by a plurality of channel sections 242 supported by adjustable feet 244, and further includes a plurality of top caps 246.

Figure 16:
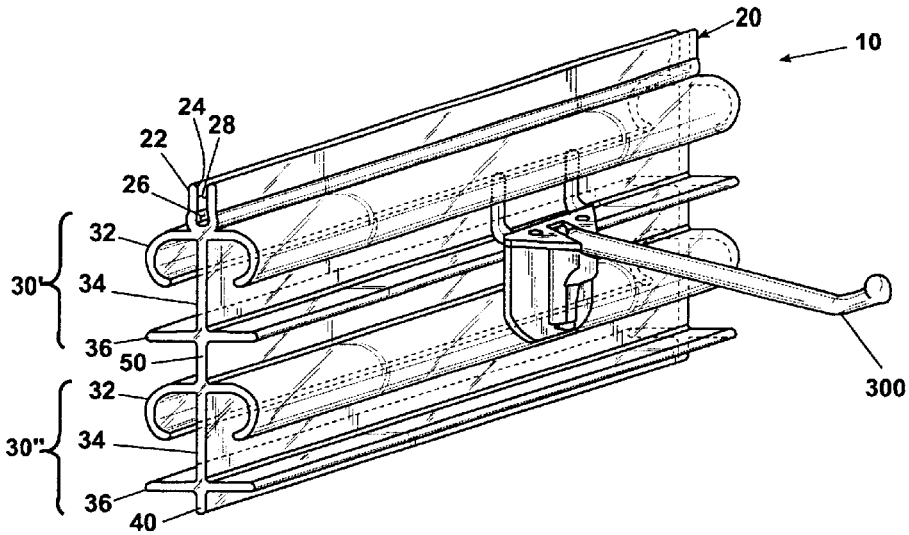
FIG. 16 is a perspective view of a clear, transparent slatwall panel section according to the invention.
Figure 17:
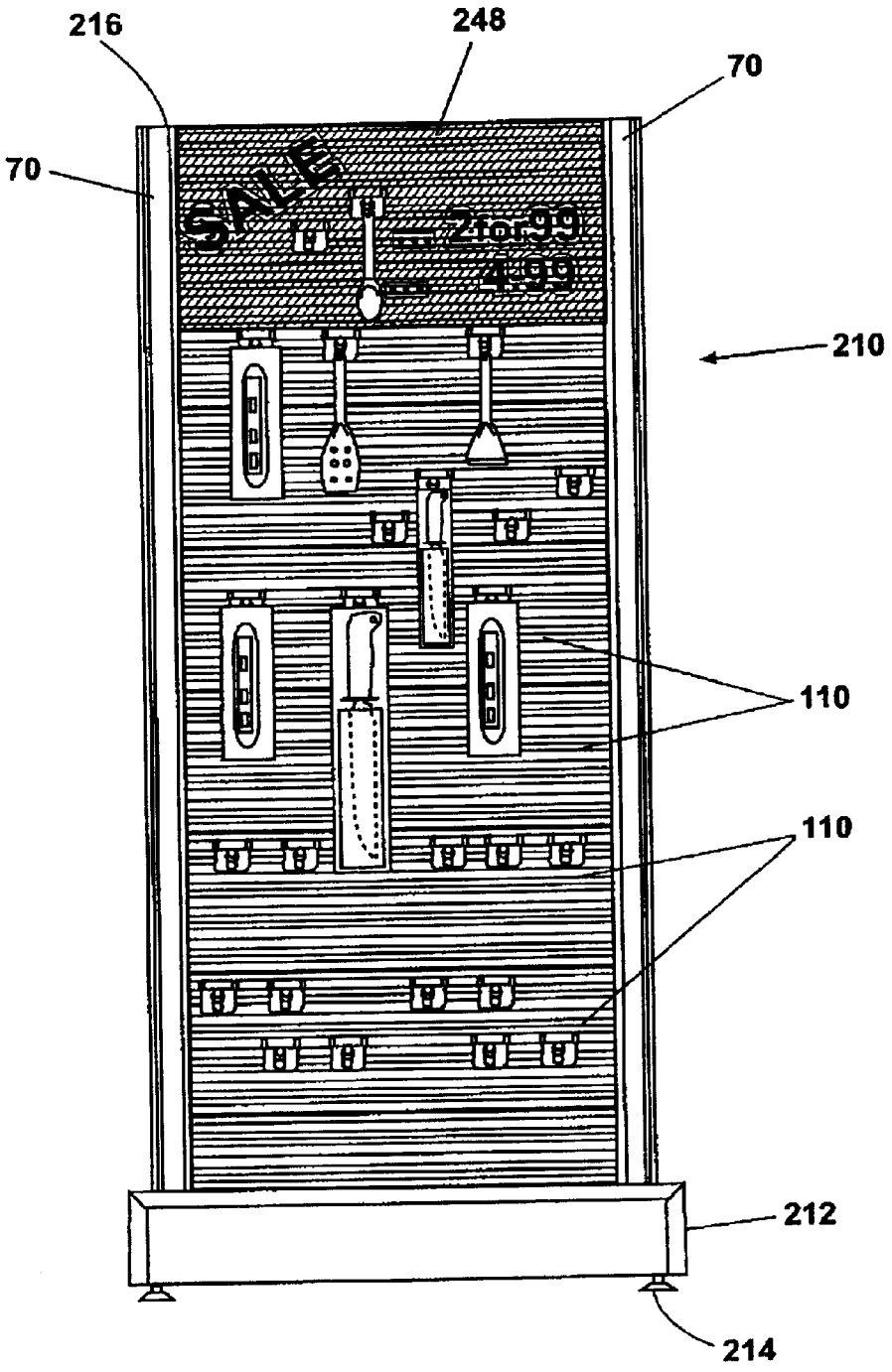
FIG. 17 is an elevation view of a further embodiment of an upright display according to the invention comprising clear slatwall panel sections through which signage can be observed.

In the preferred embodiment, the slatwall panels 10, 110 are extrusion-formed of a plastic material that can be selected to be transparent or translucent in varying degrees from clear, as shown in FIG. 16, to near-opaque, as shown in FIG. 1, such that light of selectively-variable intensity can pass through the product to meet architectural, retail, or institutional needs. As shown in FIG. 17, clear panels 110 having the flat face 160 can be assembled into a display incorporating a poster or other signage 248 in contact with the flat face 160 so that the poster 248 can be viewed through the panels 110. FIG. 17 shows the panel assembly utilized to display retail products, with the signage 248 announcing pertinent information, such as price, and drawing attention to the display. Alternatively, the panels 110 can be used to display a poster or signage for purposes other than the display of retail products, such as directional signs or theater announcements.

The slatwall panels 10, 110 can be connected as a partition or divider between adjacent areas in a retail or architectural setting. For the purposes of improving security, the slatwall panels 10, 110 can be used as a display or partition permitting surveillance beyond the panels 10, 110 due to their translucent nature. Store personnel, for instance, have the ability to see through the panel 10, 110 and to monitor shoplifting, price-switching, or other unauthorized activities. In office or residential settings, occupants have the ability to monitor unauthorized access to restricted areas, theft, vandalism, or personal threat. The slatwall panels 10, 110 can also act as a decorative light-diffusing system that is architecturally pleasing and further has the ability to display product inventory.

The slatwall panels 10, 110 can also act as part of a storage system, allowing more visual access to items due to the translucent nature of the slatwall panels 10, 110. For example, one or more panels 10, 110 can be placed in front of an existing wall or panel so that a user can see items behind the front-most panel. Such panels 10, 110 can also be mounted into a sliding track or hinged door system to provide access to items identified through the translucent panel 10, 110.

The slatwalls 10, 110 can also act as a light diffuser and provide lighting enhancement to standard fluorescent or incandescent light fixtures by mounting the slatwall panels 10, 110 either horizontally or vertically, individually or in combination, or arranged in parallel or free-form grouping.

The slatwall panels 10, 110 can be used in an inverted position (relative to that shown in FIGS. 1–5) so that the J-shaped retainers 32, 132 open upward to serve as a cable management device through which telephone, cable television, optical, data or electrical cables or wiring can be routed. The slatwall panels 10, 110 can thus act as a cable routing device while allowing light to pass therethrough. Such panels 10, 110 can be used in other work surfaces or in office partitions, in room dividers, or in retail displays.

The translucent slatwall panels 10, 110 can also serve as a decorative lighting device, in which lighted-cord, low-voltage light ribbon, or fiber optic cables can be carried. In this use, the decorative lighting cables can be routed so that light emitted from the cables can be seen through the panel 10, 110. This can be used in architectural applications, graphic information displays, or product displays for the purpose of product enhancement, illumination, or as an art form.

While the invention has been specifically described in connection with certain specific embodiments thereof, it is to be understood that this is by way of illustration and not of limitation. Reasonable variation and modification are possible within the scope of the forgoing description of the invention without departing from the scope of the invention.

What is claimed is:

1. A slatwall panel comprising:

a rectangular wall forming a structural spine defined by an upper edge, a lower edge, side edges, a front face and a rear face;

at least one retaining flange comprising a planar portion attached to the structural spine to extend outwardly from the front face of the rectangular wall, the planar portion terminating in an arcuate outer end defining a retaining channel adapted to receive a support fixture; and at least one plate-like brace extending outwardly from the front face of the rectangular wall a distance coextensive with the arcuate outer end of the retaining flange.

2. The slatwall panel according to claim 1 wherein the upper edge and the lower edge form connectors for joining like panels together in vertical juxtaposed relationship.

3. The slatwall panel according to claim 2 wherein one of the connectors comprises a flange forming a male connector.

4. The slatwall panel according to claim 2 wherein one of the connectors comprises a pair of parallel, spaced-apart flanges forming a female connector.

5. The slatwall panel according to claim 1 wherein the at least one retaining flange is J-shaped.

6. The slatwall panel according to claim 1 wherein the at least one brace has a linear cross-section.

7. The slatwall panel according to claim 1 wherein the panel is formed of an extrusion.

8. The slatwall panel according to claim 7 wherein the extrusion is a translucent plastic.

9. The slatwall panel according to claim 8 wherein the plastic is a clear polyvinyl chloride.

10. The slatwall panel according to claim 8 wherein the plastic is color tinted.

11. The slatwall panel according to claim 1 and further comprising at least one retaining flange extending outwardly from the rear face of the rectangular wall.

12. The slatwall panel according to claim 11 wherein the at least one retaining flange has an arcuate outer end defining a retaining channel adapted to receive a support fixture.

13. The slatwall panel according to claim 11 and further comprising at least one brace extending from the rear face of the rectangular wall a distance coextensive with the arcuate outer end of the retaining flange.

14. The slatwall panel according to claim 13 wherein the at least one brace has a linear cross section.

15. The slatwall panel according to claim 14 wherein the panel is formed of an extrusion.

16. The slatwall panel according to claim 15 wherein the extrusion is a translucent plastic.

17. The slatwall panel according to claim 16 wherein the plastic is a clear polyvinyl chloride.

18. The slatwall panel according to claim 16 wherein the plastic is color tinted.

19. The slatwall panel according to claim 11 wherein the at least one retaining flange is J-shaped.

20. A slatwall assembly for a display system comprising at least two slatwall panels supported in vertical juxtaposition by a frame, the slatwall panels each comprising:

a rectangular wall forming a structural spine defined by an upper edge, a lower edge, side edges, a front face and a rear face;

at least one retaining flange comprising a planar portion attached to the structural spine to extend outwardly from the front face of the rectangular wall, the planar portion terminating in an arcuate outer end defining a retaining channel adapted to receive a support fixture; and at least one plate-like brace extending outwardly from the front face of the rectangular wall a distance coextensive with the arcuate outer end of the retaining flange; and the frame comprising:

at least two vertical side frame members, each vertical side frame member defining an elongate cavity for receiving a side edges of the slatwall panels; and at least two horizontal frame members, a first one of said at least two horizontal frame members defining an elongate cavity for receiving an upper edge of one slatwall panel and a second one of said at least two horizontal frame members defining an elongate cavity for receiving a lower edge of another slatwall panel;

wherein the at least two vertical side frame members and the at least two horizontal frame members are assembled into a rectilinear frame with the at least two slatwall panels supported therein in vertical juxtaposition.

21. The slatwall assembly according to claim 20 wherein the upper edge and the lower edge form connectors joining the at least two panels together in vertical juxtaposed relationship.

22. The slatwall assembly according to claim 21 wherein one of the connectors comprises a flange forming a male connector.

23. The slatwall assembly according to claim 21 wherein one of the connectors comprises a pair of parallel, spaced-apart flanges forming a female connector.

24. The slatwall assembly according to claim 19 wherein the at least one retaining flange is J-shaped.

25. The slatwall assembly according to claim 20 wherein the at least one brace has a linear cross section.

26. The slatwall assembly according to claim 20 wherein one of said at least two slatwall panels is formed of an extrusion.

27. The slatwall assembly according to claim 26 wherein the extrusion is a translucent plastic.

28. The slatwall assembly according to claim 27 wherein the plastic is a clear polyvinyl chloride.

29. The slatwall assembly according to claim 27 wherein the plastic is color tinted.

30. The slatwall assembly according to claim 27 and further comprising signage visible through the one of said at least two slatwall panels.

31. The slatwall assembly according to claim 20 and further comprising at least one retaining flange extending outwardly from the rear face of the rectangular wall.

32. The slatwall assembly according to claim 31 wherein the at least one retaining flange has an arcuate outer end defining a retaining channel adapted to receive a support fixture.

33. The slatwall assembly according to claim 31 and further comprising at least one brace extending from the rear face of the rectangular wall a distance coextensive with the arcuate outer end of the retaining flange.

34. The slatwall assembly according to claim 33 wherein the at least one brace has a linear cross section.

35. The slatwall assembly according to claim 34 wherein at least one of the panels is extruded from a translucent plastic.

36. The slatwall assembly according to claim 35 wherein the plastic is a clear polyvinyl chloride.

37. The slatwall assembly according to claim 35 wherein the plastic is color tinted.

38. The slatwall assembly according to claim 31 wherein the at least one retaining flange is J-shaped.

39. The slatwall assembly according to claim 20 and further comprising four rectilinear frames.

40. The slatwall assembly according to claim 39 wherein the four rectilinear frames are arranged in angular juxtaposition.

41. The slatwall assembly according to claim 39 wherein the four rectilinear frames are arranged in orthogonal juxtaposition.

42. The slatwall assembly according to claim 20 and further comprising three rectilinear frames.

43. The slatwall assembly according to claim 42 wherein the three rectilinear frames are arranged in triangular juxtaposition.

44. The slatwall assembly according to claim 20 and further comprising a fixture mounted to at least one of the panels and a display article mounted on the fixture.

* * * * *

UNITED STATES PATENT AND TRADEMARK OFFICE

CERTIFICATE OF CORRECTION

PATENT NO. : 6,763,957 B1
DATED : July 20, 2004
INVENTOR(S) : Daniel Muellerleile It is certified that error appears in the above-identified patent and that said Letters Patent is hereby corrected as shown below:

Title page,
Item [12], "Mullerleile" should read -- Muellerleile --.
Item [75], Inventor, "Daniel Mullerleile" should read -- Daniel Muellerleile --

Signed and Sealed this

Fourteenth Day of September, 2004

JON W. DUDAS
*Director of the United States Patent and Trademark Office*